US005184144A

United States Patent [19]

Thombs

[11] Patent Number: 5,184,144

[45] Date of Patent: Feb. 2, 1993

[54] OGIVAL CROSS-SECTION COMBINED MICROWAVE WAVEGUIDE FOR REFLECTOR ANTENNA FEED AND SPAR SUPPORT THEREFOR

[75] Inventor: David M. Thombs, Chelmsford, Mass.

[73] Assignee: Chu Associates, Inc., Littleton, Mass.

[21] Appl. No.: 587,411

[22] Filed: Sep. 25, 1990

[51] Int. Cl.[5] ..... H01Q 1/22

[52] U.S. Cl. ..... 343/781 R; 343/840; 343/884

[58] Field of Search ..... 343/840, 781 R, 884, 343/878, 905; 333/239

[56] References Cited

U.S. PATENT DOCUMENTS

| | | | |
|---|---|---|---|
| 3,136,965 | 6/1964 | Lunden | 333/239 |
| 3,419,871 | 12/1968 | Cohen et al. | 343/781 |
| 4,712,110 | 12/1987 | Branigan et al. | 343/840 |
| 4,825,218 | 4/1989 | Begout et al. | 343/840 |

FOREIGN PATENT DOCUMENTS

| | | | |
|---|---|---|---|
| 1048970 | 1/1959 | Fed. Rep. of Germany | 333/239 |
| 3019247 | 11/1980 | Fed. Rep. of Germany | 333/239 |
| 104502 | 6/1983 | Japan | 333/239 |

*Primary Examiner*—Michael C. Wimer

*Attorney, Agent, or Firm*—Rines and Rines Shapiro and Shapiro

[57] ABSTRACT

A novel combined feedhorn-supporting spar and feed waveguide of ogival configuration.

4 Claims, 5 Drawing Sheets

OGIVAL CROSS-SECTION COMBINED MICROWAVE WAVEGUIDE FOR REFLECTOR ANTENNA FEED AND SPAR SUPPORT THEREFOR

BACKGROUND OF THE INVENTION

The present invention relates to microwave antenna systems, being more particularly directed to systems of the type having parabolic or other reflecting surfaces in front of which waveguide feed horn transmitting or receiving structures and the like are supported by support spars connected between the feed horn, as disposed at a focal region in front of the reflector, and peripheral points of the reflector.

As described in earlier U.S. Pat. No. 3,419,871, it has been found that the ogival cross-sectional shape of spars for supporting radio-frequency horn and related feed structures in front of parabolic reflecting dishes and the like have advantageous effects in providing minimal microwave reflection cross-section interferences and maximum transmission efficiency. When spars of such cross-section or other earlier cross-section spars are thus used to support the feed horn at the focal region in front of such a reflector, the microwave or other transmission line to and from the feed horn at the focal region is generally externally supported along and by one of these supporting spars.

SUMMARY OF THE INVENTION

In accordance with the present invention, it has been discovered that instead of supporting the waveguide or other transmission line external and adjacent to the feed horn supporting spars, with attendant deleterious reflection and other performance degradation in lobe pattern, gain, efficiency, etc., which has had to be tolerated in the prior art, the ogival cross-section type of spar may be designed to serve itself also as the waveguide line to and from the feed horn without the necessity for an externally mounted separate feed line.

An object of the present invention, accordingly, is to provide a new and improved combined support spar and microwave waveguide for such and other advantageous and improved purposes.

A further object is to provide a novel waveguide of ogival cross-section.

Other and further objects will be explained hereinafter and are more particularly pointed out in the appended claims.

In summary, however, from one of its important points of view, the invention embodies a microwave antenna feed support for a reflector that comprises a spar of ogival cross-section in which two arcs symmetrical about a common chord intersect one another at acute angles to define the edges of the spar, one end of which is supported at (near) the reflector rim and the other end of which connects to the antenna feed, the internal surface of the spar being of highly conductive material and the internal cross-section being dimensioned with respect to the microwave wavelength(s) to serve also as a waveguide for feeding microwave energy to and/or from the antenna feed. Preferred and best mode design and embodiments are later set forth.

BRIEF DESCRIPTION OF THE DRAWINGS

The invention will now be described in connection with the accompanying drawings, FIG. 1 of which is a cross-sectional view of a conductive ogival combined spar/waveguide constructed in accordance with a preferred embodiment of the invention.

DETAILED DESCRIPTION OF THE INVENTION

Figure 4:
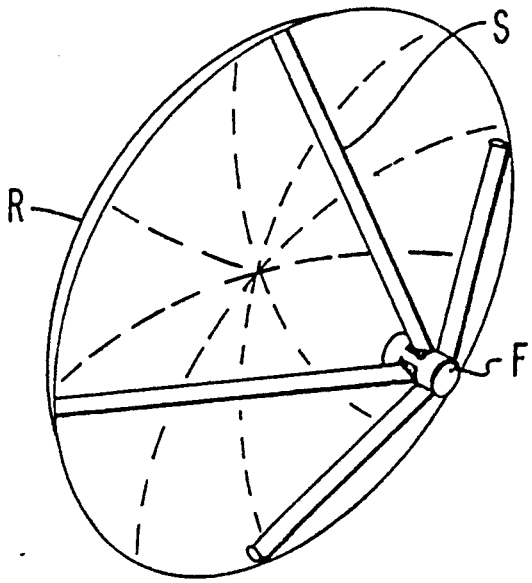
FIG. 4 is a view of the use of such a combined spar/-waveguide device for the support and feed to and from a feed horn disposed at the focal region in front of a microwave parabolic reflector.
Figure 2A:
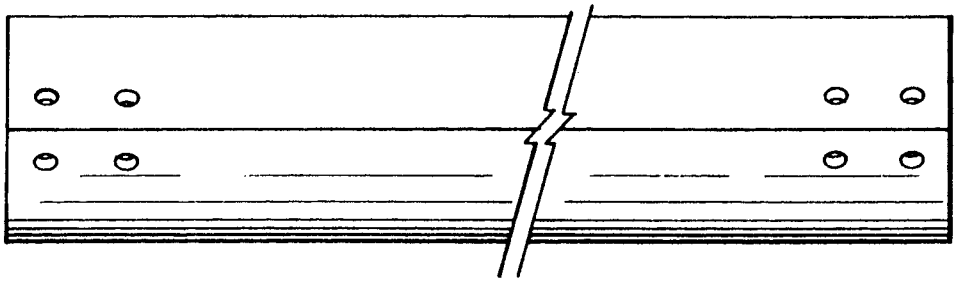
FIG. 2*a* is a side elevation of the same, with FIG. 2*b* being another cross-sectional view thereof.
Figure 2B:
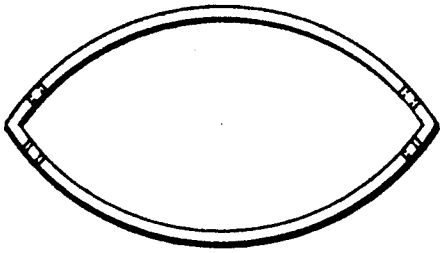

Referring to the drawings, FIG. 4 shows a microwave parabolic antenna reflector R having a feed horn F disposed at its focal region in front of the reflector and supported there by spars S that mechanically connect between the feed horn F and the rim or near-rim region of the reflector R as previously discussed. In the prior art, the microwave or other feed transmission line would be disposed adjacent and external to one of the spars S and supported therealong, connecting at one end with the feed horn F and at the other end, on the other side of the reflector R or at another point remote therefrom, being connected to the transmitting or receiving microwave apparatus, not shown, as is well known in the art.

As discussed in said earlier U.S. Pat. No. 3,419,871, the use of an ogival shape spar S provides advantages in the support structure and antenna performance. As previously stated, however, what has now been discovered is that through appropriate extrusion surface smoothness of the spar and an appropriate highly conductive inner surface thereof, and appropriate inner cross-sectional dimensions relative to the wavelength(s) of the microwave energy to be used, the internal space along the spar may itself be transformed into a very effective microwave waveguide such that, with appropriate techniques for transition, the spar may serve not only for the support purposes previously discussed, but also simultaneously as the actual transmission line feed to and from the feed horn F.

Figure 1:
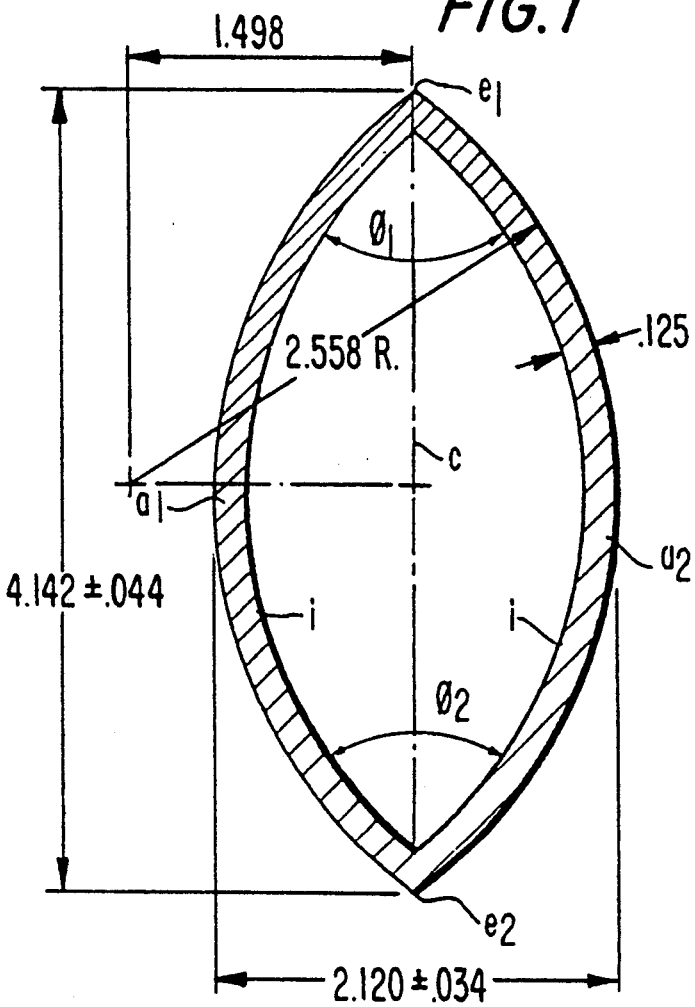
Figure 6A:
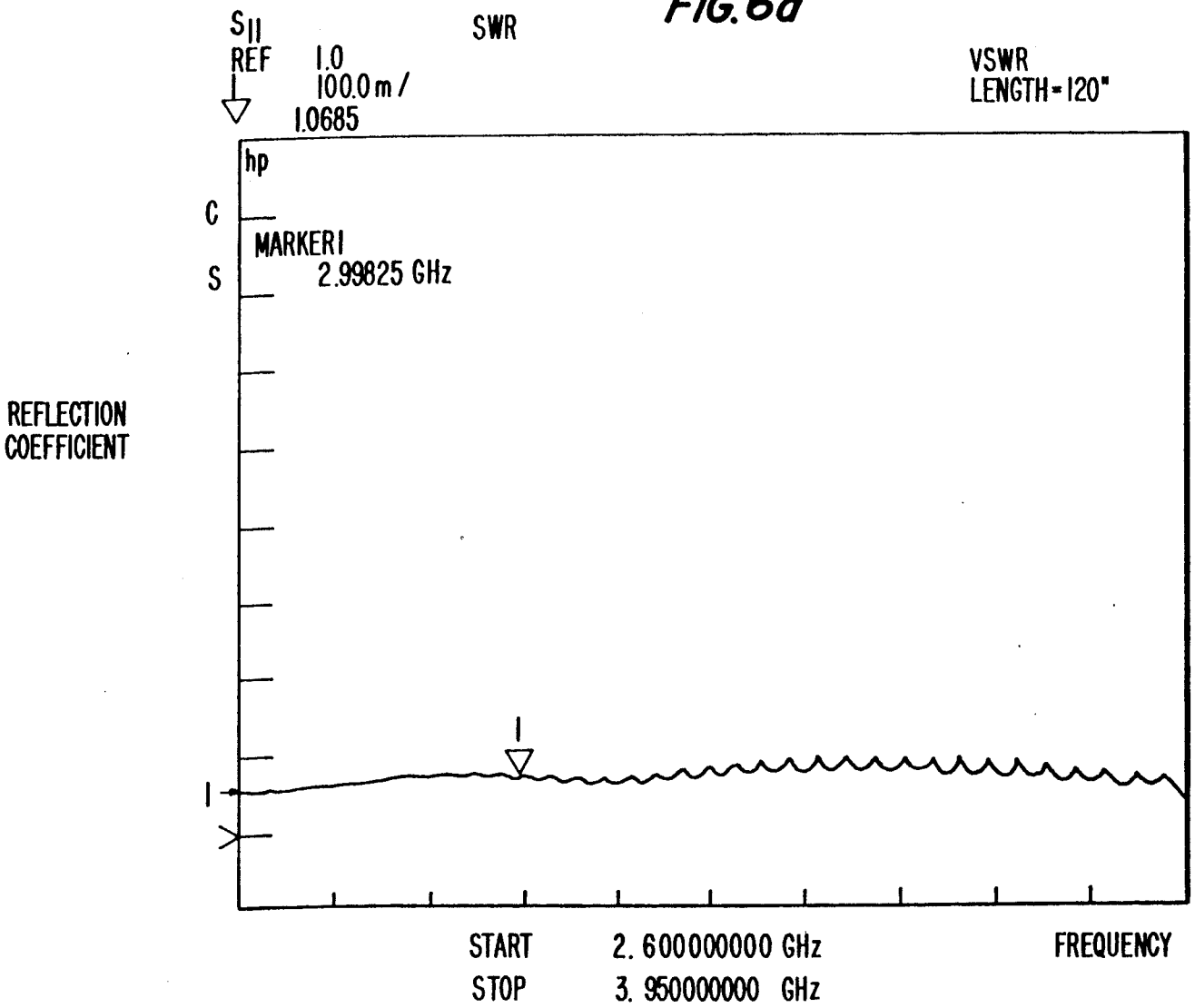
FIGS. 6*a* and 6*b* are experimentally obtained performance characteristics.
Figure 6B:
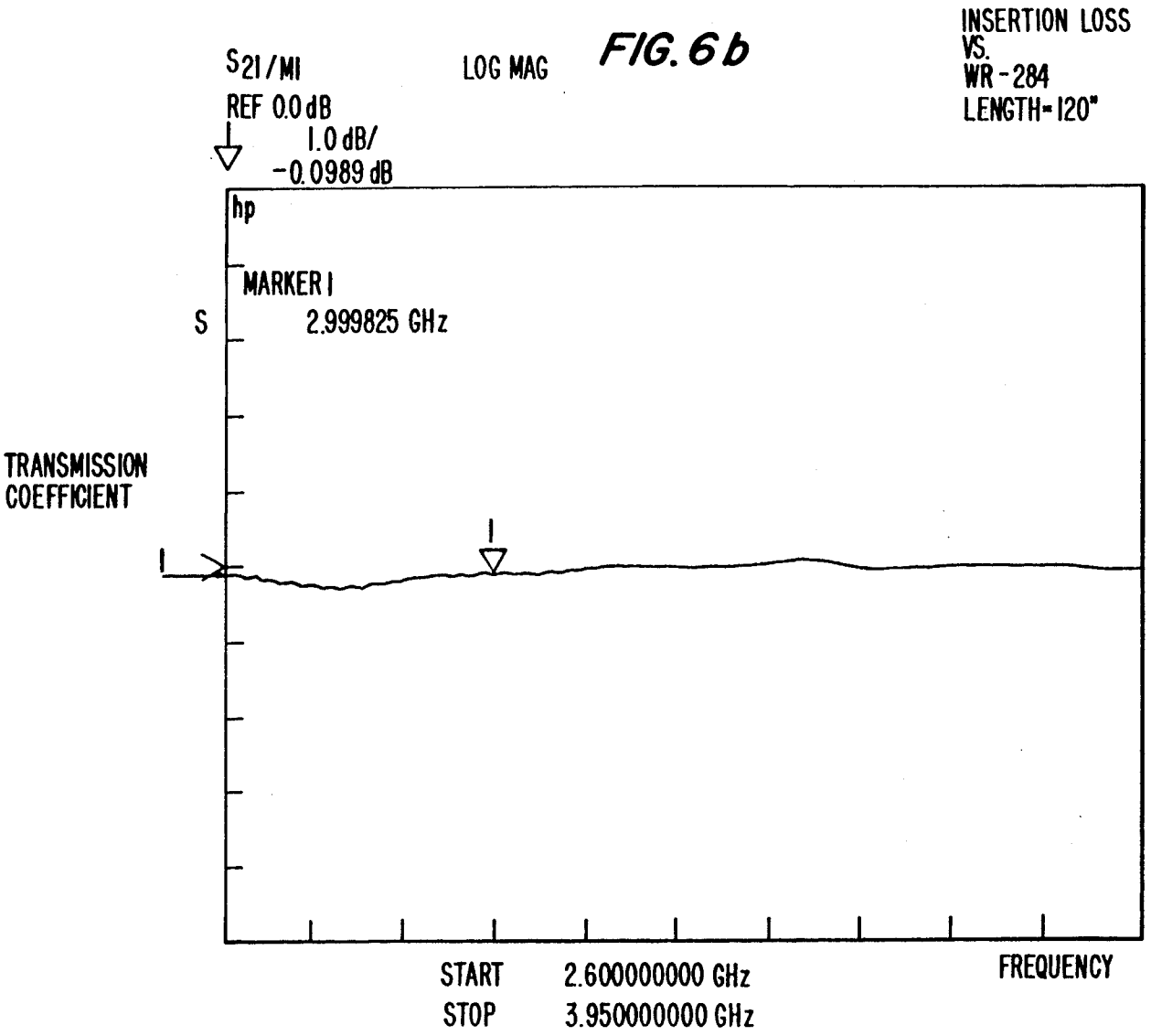

Such an appropriate design is shown in the sectional view of FIG. 1 with the dimensions therein having been found to provide waveguide transmission performance entirely comparable to standard rectangular waveguide feeds such as the WR284, as shown, for example, in FIG. 6*b*. As shown in FIG. 1, the spar/waveguide has an ogival cross-section defined by two arcuate walls $a_1$, $a_2$ symmetrical about a common chord C and intersecting one another at acute angles $\phi_1$, $\phi_2$ to form opposite edges $e_1$, $e_2$ of the spar/waveguide. In FIG. 1, the preferably extruded smooth-surface highly conductive inner surface i of the spar (as of aluminum, with or without a silver or copper plate) and the ogival cross-section have been found to provide equivalent microwave transmission characteristics, cutoff frequency, and transmission and reflection characteristics to such conventional rectangular waveguides as the WR284 (preferred frequency ranges of 2.6–3.95 GHz--i.e. 2–4 GHz generally).

Figure 3A:
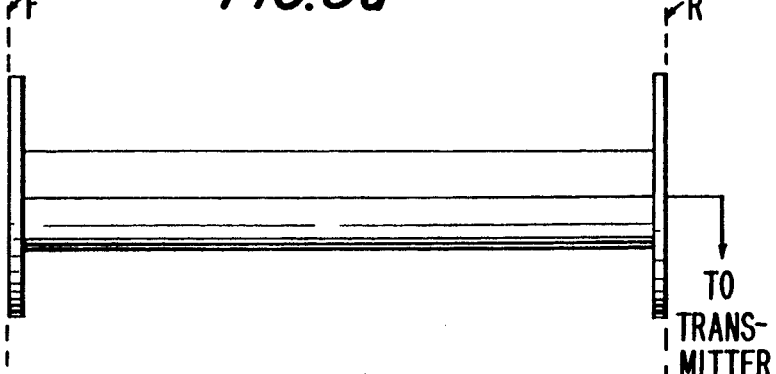
FIG. 3*a* is a diagrammatic side elevation showing end transition flanges for connection at one end to the transmitter or receiver structure of the system and at another end to the feed horn, FIGS. 3*b* and 3*c* being longitudinal views showing the use of elements for ogival-to-rectangular transition.
Figure 3C:
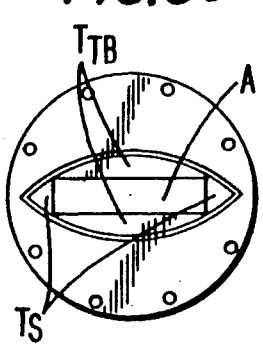
Figure 3B:
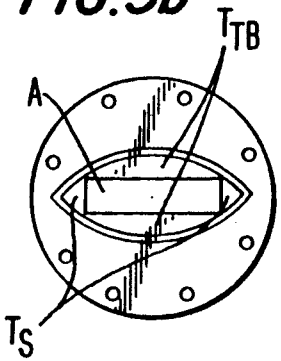
Figure 5A:
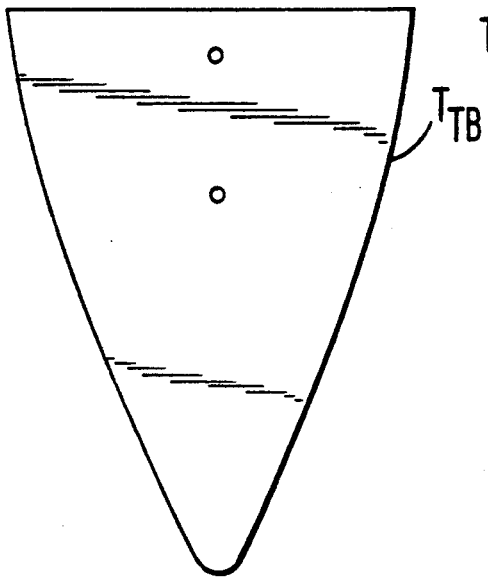
FIGS. 5*a*–5*d* show suitable elements for ogival-to-rectangular waveguide transition, FIGS. 5*a* and 5*b* respectively showing plan and side elevation views of a top/bottom transition element, and FIGS. 5*c* and 5*d* respectively showing plan and side elevation views of a side transition element.
Figure 5B:
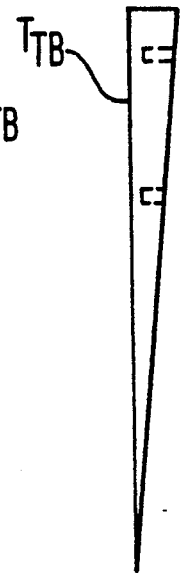
Figure 5C:
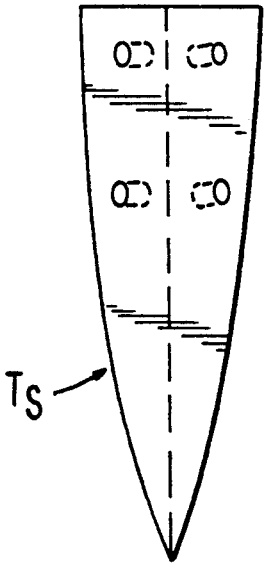
Figure 5D:
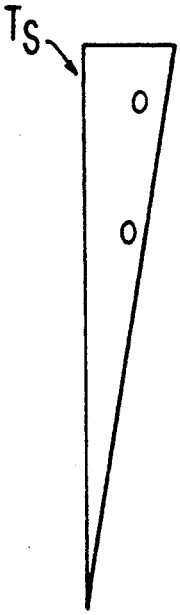

As shown in FIG. 3*a*, the spar/waveguide is provided with terminal circular waveguide flanges of larger transverse dimensions having, as shown more particularly in FIGS. 3*b*, and 3*c* rectangular apertures A in transition from the ogival cross-section for enabling connection at one end through the reflector to conventional waveguide feed apparatus to transmitting or receiving equipment, and at the other end for entry into the cavity or waveguide of the microwave feed horn F. As shown in FIGS. 3*b* and 3*c*, the rectangular apertures A are suitably formed by the use of top and bottom transition elements $T_{TB}$ together with side transition elements $T_s$ within the opposite end portions of the spar/waveguide. The transitions $T_{TB}$ may be configured as shown in FIGS. 5*a*–5*b*, and transitions $T_s$ as shown in FIGS. 5*c*–5*d*. Transition taper angles are shown in FIGS. 5*b* and 5*d*.

In practice, the spar/waveguide will ordinarily be disposed with one end having its flange abutting the surface of reflector R and connected to microwave transmitting or receiving means, with the flange at its other end being connected to the feed horn, such an arrangement being shown diagrammatically in FIG. 3*a*.

FIGS. 6*a* and 6*b* show the most satisfactory reflection and transmission characteristics obtained in actual experiments with an apparatus of the dimensions of FIG. 1, operating at microwave frequencies of 2.6 to 3.95 GHz.

As shown in FIG. 1, preferred ogival cross-sectional dimensions in inches are substantially 4.142 in overall length, 2.120 in maximum width, 0.125 in wall thickness and with a radius of curvature of 2.558 from a center located 1.498 from the longitudinal axis along the transverse axis of the spar cross section.

Further modifications will occur to those skilled in this art and such are considered to fall within the spirit and scope of this invention as defined in the appended claims.

What is claimed is:

1. A microwave antenna feed support for supporting a microwave antenna feed relative to a reflector, comprising a spar of ogival cross-section defined by two arcuate walls symmetrical about a common chord and meeting one another at acute angles to form edges of the spar, the spar having one end which is supported near a rim of the reflector, another end which connects to the antenna feed, and an internal surface of highly conductive material, and being internally cross-dimensioned with respect to the microwave wavelength to serve also as a waveguide for feeding microwave energy to and/or from the antenna feed, and further wherein the spar is terminated at said ends thereof by circular flanges of larger transverse dimensions and having rectangular waveguide transition apertures within and bounded by the ogival cross-section.

2. An antenna feed support as claimed in claim 1 and in which the spar is formed of extruded aluminum.

3. An antenna feed support as claimed in claim 1, the said one end of of the spar having its flange abutting the reflector surface and connected to microwave transmitting or receiving means, and the flange at said another end of the spar being connected to a feed horn.

4. An antenna feed support as claimed in claim 1 and in which the ogival cross-sectional dimensions in inches are substantially 4.142 in overall length, 2.120 in maximum width, 0.125 in wall thickness and with a radius of curvature of 2.558 from a center located 1.498 from a longitudinal axis of the spar cross-section along a transverse axis of the spar cross-section.

* * * * *